US006578777B2

(12) United States Patent
Bui

(10) Patent No.: US 6,578,777 B2
(45) Date of Patent: Jun. 17, 2003

(54) LOW PRESSURE SPRAY NOZZLE

(75) Inventor: Quy D. Bui, West Columbia, SC (US)

(73) Assignee: Delavan Inc., West Des Moines, IA (US)

( * ) Notice: Subject to any disclaimer, the term of this patent is extended or adjusted under 35 U.S.C. 154(b) by 0 days.

(21) Appl. No.: 10/247,207

(22) Filed: Sep. 19, 2002

(65) Prior Publication Data

US 2003/0052197 A1 Mar. 20, 2003

Related U.S. Application Data

(60) Provisional application No. 60/323,687, filed on Sep. 20, 2001.

(51) Int. Cl.[7] ..... B05B 7/10

(52) U.S. Cl. ..... 239/406; 239/463; 239/490

(58) Field of Search ..... 239/400, 403–406, 239/492, 497, 398, 399, 418, 419, 423, 424, 424.5, 425, 461, 463, 490, 491, 474, 475, 290

(56) References Cited

U.S. PATENT DOCUMENTS 3,512,719 A 5/1970 Phelps et al.
5,086,979 A 2/1992 Koblish et al.
5,921,470 A 7/1999 Kamath

FOREIGN PATENT DOCUMENTS

DE 3640818 C1 9/1988

*Primary Examiner*—Lisa A. Douglas
(74) *Attorney, Agent, or Firm*—Scott D. Wofsy; Edwards & Angell, LLP

(57) ABSTRACT

A spray nozzle is disclosed which includes an elongated nozzle body having an axially extending interior chamber and at least two radially extending air inlet ports communicating with the interior chamber. An elongated fluid inlet fitting having an axial fluid inlet passage is axially disposed within the interior chamber of the nozzle body. A fluid distribution insert is axially disposed within the axial fluid inlet passage of the fluid inlet fitting. The fluid distribution insert has an axial impact chamber formed therein, and an axial fluid feeding orifice which communicates with the axial impact chamber. An air swirling insert is disposed within the nozzle body. The air swirling insert has an interior bore for receiving the fluid distribution insert, and a fluid mixing orifice communicating with the fluid feeding orifice of the fluid distribution insert. A fluid metering insert is axially disposed within the impact chamber of the fluid distribution insert. The fluid metering insert has a metering orifice providing fluid communication between the impact chamber of the fluid distribution insert and the axial fluid inlet passage of the fluid inlet fitting. The metering orifice is offset from the axis of the fluid feeding orifice, and has a smaller diameter than the fluid feeding orifice.

23 Claims, 2 Drawing Sheets

LOW PRESSURE SPRAY NOZZLE

CROSS-REFERENCE TO RELATED APPLICATIONS

This application claims the benefit of priority to U.S. Provisional Patent Application Ser. No. 60/323,687 filed Sep. 20, 2001, the disclosure of which is herein incorporated by reference in its entirety.

BACKGROUND OF THE INVENTION

1. Field of the Invention

The subject invention is directed to a nozzle for producing a uniform spray of small fluid droplets using a low pressure supply of air and fluid.

2. Background of the Related Art

In the past, the low pressure air available in gas turbine engines and oil burners has been used to assist in the atomization of fuel. The low air pressure in a gas turbine engine generally stems from the engine air circulation, while the low air pressure in an oil burner typically arises from a blower.

The quality of an atomized spray assisted by low pressure air depends on the manner in which the liquid is introduced into the air flow. Most current nozzle designs, for example, U.S. Pat. No. 5,921,470 to Kamath and U.S. Pat. No. 5,086,979 to Koblish et al., have introduced a liquid film into a swirling air flow. In these instances, the liquid film is surrounded by the air flow and sheared into small drops. In the oil burner spray nozzle disclosed in U.S. Pat. No. 5,921,470 to Kamath, the air flow interacts with one side of the liquid film, whereas in the gas turbine spray nozzle disclosed in U.S. Pat. No. 5,086,979 to Koblish et al., the air flow interacts with both sides of the liquid film.

In both instances, the liquid film is generated by several relatively small diameter fluid passages. In particular, in U.S. Pat. No. 5,086,979 to Koblish et al., several radially extending fluid passages deliver oil to an annular atomizing chamber. Similarly, in U.S. Pat. No. 5,921,470 to Kamath, several circumferentially spaced fuel passages deliver fuel to an annular atomizing chamber. In each case, the uniformity of the liquid film produced by the plurality of fuel passages determines the uniformity of the spray pattern. However, the use of several very small fluid passages often results in clogging of the nozzle. Once a fuel passage is clogged, the uniformity of the spray pattern and the operating efficiency of the nozzle are compromised. Consequently, the nozzle must be removed from the operating environment for cleaning or discarded and replaced.

It would be beneficial therefore to provide a low pressure spray nozzle for use in gas turbine or oil burner applications that is adapted and configured to produce a uniform spray pattern of small fluid droplets using a low pressure air and fluid supply, which is not easily susceptible to becoming clogged during use.

SUMMARY OF THE INVENTION

The subject invention is directed to a new and useful nozzle for producing a uniform spray of small fluid droplets using a low pressure supply of air and fluid which is particularly well suited for deployment in oil burners and gas turbines. The spray nozzle includes an elongated nozzle body having an axially extending interior chamber defined in part by a tapered distal wall portion. The interior chamber opens into an outwardly tapered exit orifice formed at a distal end of the nozzle body. The nozzle body has at least two radial air inlet ports communicating with the interior chamber, and preferably two diametrically opposed air inlet ports. The air inlet ports communicate with a source of low pressure air.

The nozzle further includes a fluid inlet fitting that is axially disposed within the interior chamber of the nozzle body, and preferably threadably supported therein. The fluid inlet fitting has an axially extending fluid inlet passage which defines a proximal fluid inlet port for communicating with a source of low pressure fluid.

A fluid distribution insert is axially disposed within a distal end portion of the axial fluid inlet passage of the fluid inlet fitting. The fluid distribution insert has an axially extending impact chamber formed therein, and an axial fluid feeding orifice which extends from the impact chamber. The fluid distribution insert further includes a radially inner set of circumferentially disposed air swirling vanes on an inwardly tapered exterior surface thereof. The radially inner set of air swirling vanes impart a rotational component of motion to the low pressure air flowing past the fluid distribution insert.

An air swirling insert is axially disposed within a distal portion of interior chamber of the nozzle body. The air swirling insert has an interior bore for receiving the fluid distribution insert, and an axial fluid mixing orifice communicating with the axial fluid feeding orifice of the fluid distribution insert. The air swirling insert further includes a radially outer set of circumferentially disposed air swirling vanes on an inwardly tapered exterior surface thereof. The radially outer set of air swirling vanes impart a rotational component of motion to the low pressure air flowing between the air swirling insert and the tapered distal wall portion of the interior chamber of the nozzle body.

A fluid metering insert is axially disposed within the impact chamber of the fluid distribution insert. The fluid metering insert has a metering orifice that provides fluid communication between the impact chamber of the fluid distribution insert and the axial fluid inlet passage of the fluid inlet fitting. Preferably, the metering orifice of the fluid metering insert is offset from the axis of the fluid feeding orifice and has a smaller diameter than the fluid feeding orifice of the fluid distribution insert. The offset causes the fluid to impact the front wall of the impact chamber, resulting in decreased fluid velocity. The fluid velocity is further decreased as it flows through the fluid feeding orifice which has a larger diameter than the metering orifice. The introduction of the low velocity fluid into the swirling air provides favorable condition for shearing the fluid into small droplets.

These and other aspects of the low pressure spray nozzle disclosed herein will become more readily apparent to those having ordinary skill in the art from the following description of the drawings taken in conjunction with the detailed description of the preferred embodiments of the invention.

BRIEF DESCRIPTION OF THE DRAWINGS

So that those having ordinary skill in the art to which the subject invention pertains will more readily understand how to make and use the low pressure spray nozzle of the subject invention, preferred embodiments thereof will be described in detail hereinbelow with reference to the drawings, wherein.

DETAILED DESCRIPTION OF PREFERRED EMBODIMENTS

Figure 1:
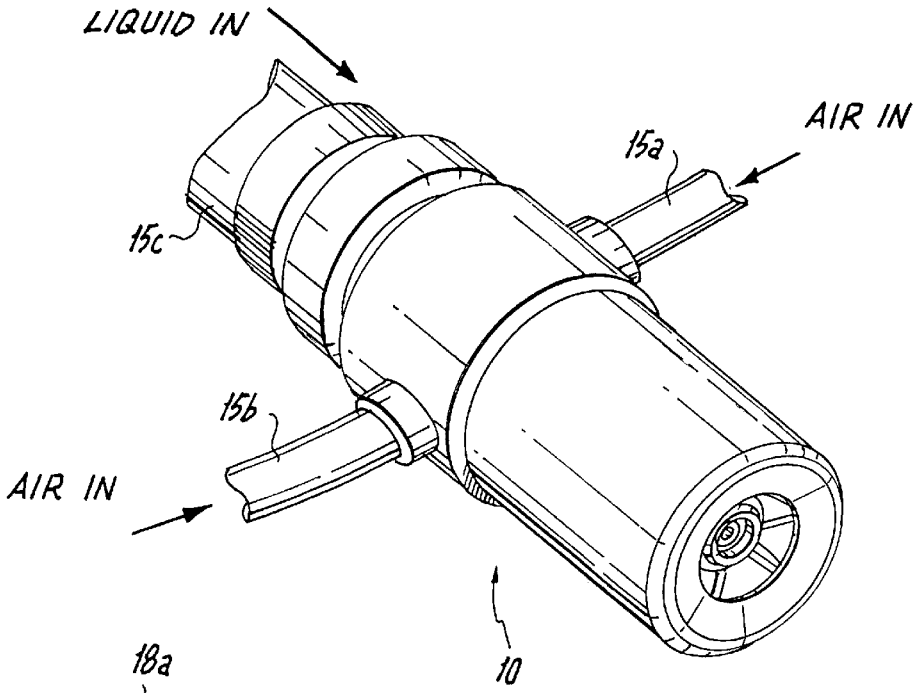
FIG. 1 is a perspective view of a low pressure spray nozzle constructed in accordance with a preferred embodiment of the subject invention.

Referring now to the drawings wherein like reference numerals identify similar structural elements of the device disclosed herein, there is illustrated in FIG. 1 a low pressure spray nozzle constructed in accordance with a preferred embodiment of the subject invention and designated generally by reference numeral 10. Spray nozzle 10 is adapted and configured to produce a uniform spray of small fluid droplets using a low pressure supply of air and fluid. The spray nozzle of the subject invention may be employed in a variety of applications including oil burner and gas turbine applications.

Figure 2:
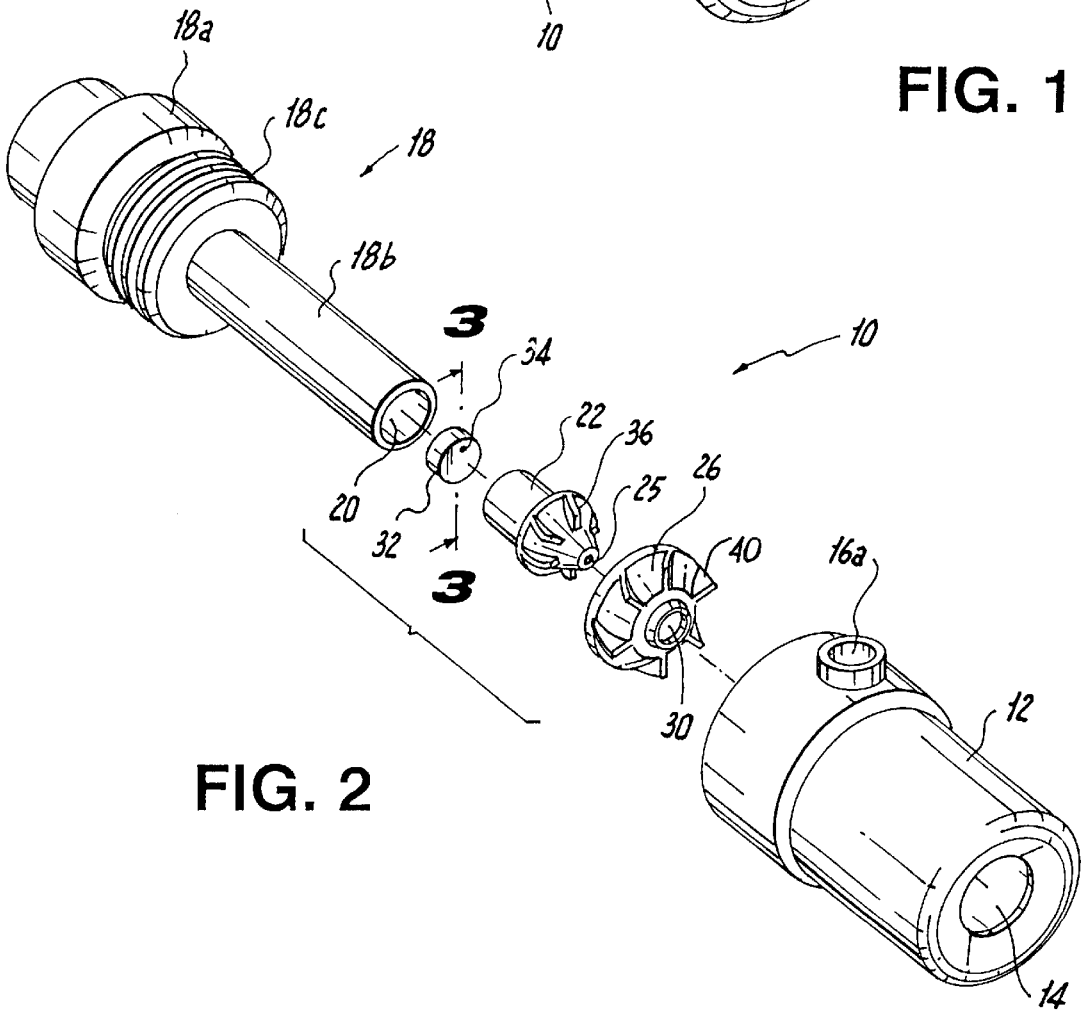
FIG. 2 is an exploded perspective view of the low pressure spray nozzle of FIG. 1 with parts separated for ease of illustration.
Figure 6:
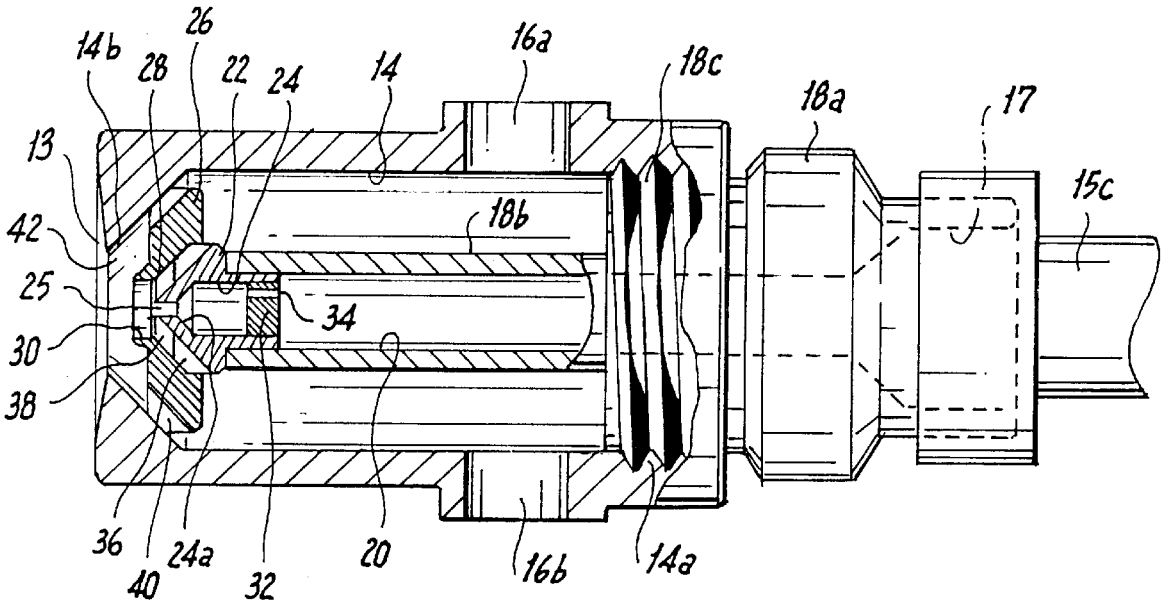
FIG. 6 is a side elevational view in cross-section of the low pressure spray nozzle of FIG. 1 illustrating the relative arrangement of the components thereof.

Referring to FIGS. 2 and 6, spray nozzle 10 includes an elongated nozzle body 12 having an axially extending interior chamber 14 of tubular configuration and defining a longitudinal axis. The interior chamber 14 of nozzle body 12 opens into an outwardly tapered exit orifice 13 formed at the distal end of nozzle body 12. Nozzle body 12 has at least two radial air inlet ports 16*a,* 16*b* that communicate with interior chamber 14. The air inlet ports 16*a,* 16*b* are preferably diametrically opposed from one another, but in instances in which there are three or more air inlet ports provided on the nozzle body, the ports would be equally spaced about the periphery of the nozzle body. The air inlet ports 16*a,* 16*b* of nozzle body 12 communicate with corresponding air supply conduits 15*a,* 15*b* as shown in FIG. 1, which could be associated with an air supply manifold for delivering pressurized air to the nozzle.

A fluid inlet fitting 18 is axially disposed within the interior chamber 14 of the nozzle body 12. Fluid inlet fitting 18 has a proximal body portion 18*a* and a tubular extension 18*b* which depends from the body portion 18*a*. The proximal body portion 18*a* of fluid inlet fitting 18 has a threaded portion 18*c* which cooperates with a corresponding threaded surface 14*a* formed within the interior chamber 14 of nozzle body 12. The threaded engagement of the fluid inlet fitting 18 and the nozzle body 12 facilitates the ready removal of the fluid inlet fitting 18 from the nozzle body 12 to perform routine maintenance on the nozzle assembly. An axially extending fluid inlet passage 20 extends through tubular extension 18*b* from a proximal fluid inlet port 17. The fluid inlet port 17 of fluid inlet fitting 18 communicates with a fluid supply conduit 15*c* for delivering pressurized fluid to the nozzle, as shown in FIG. 1.

A fluid distribution insert 22 is axially disposed within the distal end of the fluid inlet passage 20 of fluid inlet fitting 18, and is maintained therein by a press fit caused by the threaded engagement of the fluid inlet fitting 18 and the nozzle body 12. Fluid distribution insert 22 has an axially extending impact chamber 24 formed therein, and an axial fluid feeding orifice 25 which extends from the impact chamber 24. Impact chamber 24 has a generally cylindrical configuration and a forward wall 24*a* that is inwardly tapered toward the fluid feeding orifice 25.

An air swirling insert 26 is disposed within the interior chamber 14 of the nozzle body 12 downstream from the fluid distribution insert 22. Air swirling insert 26 has an axial bore 28 for receiving the fluid distribution insert 22, and an axial fluid mixing orifice 30. Fluid mixing orifice 30 has an annular configuration and communicates with the axial fluid feeding orifice 25 of the fluid distribution insert 22, as best seen in FIG. 6.

A disc shaped fluid metering insert 32 is axially disposed within the impact chamber 24 of the fluid distribution insert 22. The fluid metering insert 32 has a metering orifice 34 which provides fluid communication between the impact chamber 24 of the fluid distribution insert 22 and the axial fluid inlet passage 20 of the fluid inlet fitting 18. The metering orifice 34 of the fluid metering insert 32 has a smaller diameter than the fluid feeding orifice 25 of the fluid distribution insert 22.

Figure 3:
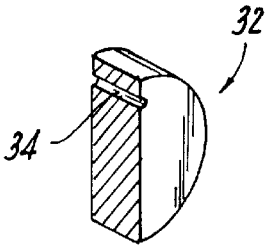
FIGS. 3 through 5 are perspective views, in cross-section taken along line 3—3 of FIG. 2, illustrating three different embodiments of a fluid metering insert which forms part of the low pressure spray nozzle of FIG. 1.
Figure 4:
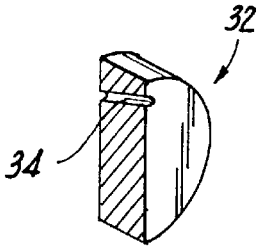
Figure 5:
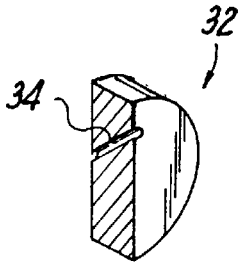

The metering orifice 34 of the fluid metering insert 32 is offset from the axis of the fluid feeding orifice 25. In one embodiment of the subject invention, the metering orifice 34 of metering insert 32 extends parallel to the axis of fluid feeding orifice 25 of the fluid distribution insert 22, as best seen in FIG. 3. Alternatively, the metering orifice 34 of metering insert 32 is both offset from the from the axis of the fluid feeding orifice 24 and disposed at an angle thereto. For example, the metering orifice 34 may be disposed at a 30° angle with respect to the axis of the fluid feeding orifice 25 as shown in FIG. 4, or at 45° angle as shown in FIG. 5. In each instance, the metering orifice 34 is positioned relative to the fluid feeding orifice 25 in such a manner so that fluid passing therethrough impacts the forward wall 24*a* of the impact chamber 24 of fluid distribution insert 22 so as to reduce the velocity of the fluid before it reaches the fluid feeding orifice 25.

The fluid velocity is further decreased as it flows through the fluid feeding orifice 25, since it has a greater diameter than the metering orifice 34. Because the metering insert 32 of nozzle assembly 10 has a single relatively large diameter metering orifice 34, rather than several smaller diameter metering orifices as found in prior art nozzles of this type, clogging is minimized. Consequently, the useful service life of the nozzle assembly is increased.

As best seen in FIG. 2, the fluid distribution insert 22 has a radially inner set of circumferentially disposed air swirling vanes 36 on an inwardly tapered exterior surface thereof. The air swirling vanes 36 impart a rotational component of motion to the low pressure air flowing between the interior surface of the axial bore 28 of air swirling insert 26 and the exterior surface of the fluid distribution insert 22. The air swirling vanes 36 direct swirling air through the conical passage 38 and toward the fluid mixing chamber 30 of air swirling insert 26 to interact with the fluid exiting fluid feeding orifice 25.

In addition, the air swirling insert 26 has a radially outer set of circumferentially disposed air swirling vanes 40 on an inwardly tapered exterior surface thereof. The air swirling vanes 40 impart a rotational component of motion to the low pressure air flowing between the exterior surface of the air swirling insert 26 and a tapered distal wall portion 14*b* of the interior chamber 14 of the nozzle body 12. The air swirling vanes 40 direct swirling air toward the fluid mixing chamber 42 to interact with sheared fluid drops exiting the fluid mixing chamber 30 of air swirling insert 26.

The air swirling vanes 36, 40 can take a variety of shapes or profiles and can vary in number so as to achieve the desired swirling motion of the air. It is envisioned that the swirling or rotating air flow can be generated by forming a plurality of grooves or slots in adjacent surfaces of the nozzle components, instead of or in addition to the air vanes.

In operation, pressurized fluid at enters the proximal fluid inlet port 17 of fluid inlet fitting 18 at a relatively low operating pressure (e.g., 0.2–5.0 psi), while pressurized air enters the nozzle body 12 through air inlet ports 16*a,* 16*b* at a similar relatively low operating pressure (e.g., 0.2–5.0 psi). The pressurized fluid flows through the liquid metering orifice 34 of metering insert 32 and impacts against the forward wall 24*a* of impact chamber 24. Thereafter, with the velocity of the fluid reduced as a result of the impact with wall 24*a,* the fluid flows into the axial fluid feeding orifice 25 of fluid distribution insert 22.

The axial fluid flow exiting from the fluid feeding orifice 25 of fluid distribution insert 22 is introduced to the center of the swirling air flow produced by the radially inner set of air vanes 36 within fluid mixing orifice 30. Thereupon, the fluid is sheared into small drops. The small drops of fluid exit from the fluid mixing orifice 30, and are further sheared into smaller fluid droplets by introduction to the center of the swirling air flow produced by the outer set of air vanes 40 within fluid mixing chamber 42. These fine droplets of fluid are then emitted from the outwardly tapered exit orifice 13 of nozzle body 12 in a uniform cone shaped spray distribution pattern.

In sum, it should be readily appreciated by those skilled in the art, that the introduction of a metered amount of fluid through a metering orifice 34 that is smaller in diameter than the liquid feeding orifice 25, and offset from the liquid feeding orifice 25 is extremely advantageous. In particular, the offset between the metering orifice 34 and the fluid feeding orifice 25 causes the fluid to impact on the inside of the impact chamber 24, resulting in a decrease in fluid velocity. The velocity of the fluid is then further decreased as it flows through the larger diameter fluid feeding orifice 25. The introduction of the low velocity fluid into the swirling air provides a favorable condition for the air to shear the liquid flow into small droplets.

Although the spray nozzle of the subject invention has been described with respect to a preferred embodiment, those skilled in the art will readily appreciate that changes and modifications may be made thereto without departing from the spirit and scope of the present invention.

What is claimed is:

1. A spray nozzle comprising:

a) an elongated nozzle body having an axially extending interior chamber and at least two radial air inlet ports communicating with the interior chamber;

b) a fluid inlet fitting axially disposed within the interior chamber of the nozzle body and having an axially extending fluid inlet passage;

c) a fluid distribution insert axially disposed within the fluid inlet passage of the fluid inlet fitting, the fluid distribution insert having an axially extending impact chamber formed therein, and an axial fluid feeding orifice which extends from the impact chamber;

d) an air swirling insert disposed within the interior chamber of the nozzle body, the air swirling insert having an axial bore for receiving the fluid distribution insert, and an axial fluid mixing orifice communicating with the axial fluid feeding orifice of the fluid distribution insert; and e) a fluid metering insert axially disposed within the impact chamber of the fluid distribution insert, the fluid metering insert having a metering orifice providing fluid communication between the impact chamber of the fluid distribution insert and the axial fluid inlet passage of the fluid inlet fitting, wherein the metering orifice of the fluid metering insert has a smaller diameter than the fluid feeding orifice of the fluid distribution insert.

2. A spray nozzle as recited in claim 1, wherein the metering orifice of the fluid metering insert is offset from the axis of the fluid feeding orifice.

3. A spray nozzle as recited in claim 1, wherein the metering orifice of the metering insert extends parallel to the axis of fluid feeding orifice of the fluid distribution insert.

4. A spray nozzle as recited in claim 1, wherein the metering orifice of the metering insert extends at an angle to the axis of fluid feeding orifice of the fluid distribution insert.

5. A spray nozzle as recited in claim 1, wherein the fluid distribution insert has a radially inner set of circumferentially disposed air swirling vanes on an inwardly tapered exterior surface thereof.

6. A spray nozzle as recited in claim 1, wherein the air swirling insert has a radially outer set of circumferentially disposed air swirling vanes on an inwardly tapered exterior surface thereof.

7. A spray nozzle as recited in claim 1, wherein the interior chamber of the nozzle body opens into an outwardly tapered exit orifice formed at a distal end of the nozzle body.

8. A spray nozzle as recited in claim 1, wherein the axially extending fluid inlet passage of the fluid inlet fitting has a proximal fluid inlet port.

9. A spray nozzle as recited in claim 1, wherein the fluid inlet fitting is threadably supported within the interior chamber of the nozzle body.

10. A spray nozzle comprising:

a) an elongated nozzle body having an axially extending interior chamber defined in part by a tapered distal wall portion, the nozzle body having at least two radial air inlet ports communicating with the interior chamber;

b) a fluid inlet fitting axially disposed within the interior chamber of the nozzle body and having an axially extending fluid inlet passage defining a proximal fluid inlet port;

c) a fluid distribution insert axially disposed within a distal end portion of the fluid inlet passage of the fluid inlet fitting, the fluid distribution insert having an axially extending impact chamber formed therein, and an axial fluid feeding orifice which extends from the impact chamber;

d) an air swirling insert disposed within a distal end portion of the interior chamber of the nozzle body, the air swirling insert having an axial bore for receiving the fluid distribution insert, and an axial fluid mixing orifice communicating with the axial fluid feeding orifice of the fluid distribution insert; and e) a fluid metering insert axially disposed within the impact chamber of the fluid distribution insert, the fluid metering insert having a metering orifice providing fluid communication between the impact chamber of the fluid distribution insert and the axial fluid inlet passage of the fluid inlet fitting, wherein the metering orifice of the fluid metering insert is offset from the axis of the fluid feeding orifice.

11. A spray nozzle as recited in claim 10, wherein the fluid distribution insert has a radially inner set of circumferentially disposed air swirling vanes on an inwardly tapered exterior surface thereof.

12. A spray nozzle as recited in claim 10, wherein the air swirling insert has a radially outer set of circumferentially disposed air swirling vanes on an inwardly tapered exterior surface thereof.

13. A spray nozzle as recited in claim 10, wherein the nozzle body has two diametrically opposed radial air inlet ports communicating with the interior chamber.

14. A spray nozzle as recited in claim 10, wherein the metering orifice of the fluid metering insert has a smaller diameter than the fluid feeding orifice of the fluid distribution insert.

15. A spray nozzle as recited in claim 10, wherein the metering orifice of the metering insert extends parallel to the axis of fluid feeding orifice of the fluid distribution insert.

16. A spray nozzle as recited in claim 10, wherein the metering orifice of the metering insert extends at an angle to the axis of fluid feeding orifice of the fluid distribution insert.

17. A spray nozzle as recited in claim 10, wherein the interior chamber of the nozzle body opens into an outwardly tapered exit orifice formed at a distal end of the nozzle body.

18. A spray nozzle as recited in claim 10, wherein the fluid inlet fitting is threadably supported within the interior chamber of the nozzle body.

19. A spray nozzle comprising:

a) an elongated nozzle body having an axially extending interior chamber defined in part by a tapered distal wall portion, the nozzle body having two diametrically opposed radial air inlet ports communicating with the interior chamber b) a fluid inlet fitting axially disposed within the interior chamber of the nozzle body and having an axially extending fluid inlet passage defining a proximal fluid inlet port;

c) a fluid distribution insert axially disposed within a distal end portion of the axial fluid inlet passage of the fluid inlet fitting, the fluid distribution insert having an axially extending impact chamber formed therein, an axial fluid feeding orifice which extends from the impact chamber, and a radially inner set of circumferentially disposed air swirling vanes on an inwardly tapered exterior surface thereof;

d) an air swirling insert axially disposed within a distal portion of interior chamber of the nozzle body, the air swirling insert having an interior bore for receiving the fluid distribution insert, an axial fluid mixing orifice communicating with the axial fluid feeding orifice of the fluid distribution insert, and a radially outer set of circumferentially disposed air swirling vanes on an inwardly tapered exterior surface thereof; and e) a fluid metering insert axially disposed within the impact chamber of the fluid distribution insert, the fluid metering insert having a metering orifice providing fluid communication between the impact chamber of the fluid distribution insert and the axial fluid inlet passage of the fluid inlet fitting, wherein the metering orifice of the fluid metering insert is offset from the axis of the fluid feeding orifice and has a smaller diameter than the fluid feeding orifice of the fluid distribution insert.

20. A spray nozzle as recited in claim 19, wherein the interior chamber of the nozzle body opens into an outwardly tapered exit orifice formed at a distal end of the nozzle body.

21. A spray nozzle as recited in claim 19, wherein the fluid inlet fitting is threadably supported within the interior chamber of the nozzle body.

22. A spray nozzle as recited in claim 19, wherein the metering orifice of the metering insert extends parallel to the axis of fluid feeding orifice of the fluid distribution insert.

23. A spray nozzle as recited in claim 19, wherein the metering orifice of the metering insert extends at an angle to the axis of fluid feeding orifice of the fluid distribution insert.

* * * * *